US007793986B2

(12) United States Patent
Liang

(10) Patent No.: US 7,793,986 B2
(45) Date of Patent: Sep. 14, 2010

(54) STRUCTURE FOR BOOK COVER

(75) Inventor: Chiu-Lieh Liang, Taichung (TW)

(73) Assignee: C. & T. Enterprises Co., Ltd., Taichung (TW)

( * ) Notice: Subject to any disclaimer, the term of this patent is extended or adjusted under 35 U.S.C. 154(b) by 267 days.

(21) Appl. No.: 11/504,709

(22) Filed: Aug. 16, 2006

(65) Prior Publication Data

US 2008/0042421 A1 Feb. 21, 2008

(51) Int. Cl.

| | |
|---|---|
| ***B42D 3/00*** | (2006.01) |
| ***B42D 1/00*** | (2006.01) |
| ***B42D 3/04*** | (2006.01) |
| ***B42C 11/00*** | (2006.01) |
| ***B42C 9/00*** | (2006.01) |
| ***B42F 3/06*** | (2006.01) |
| ***B42F 13/00*** | (2006.01) |

(52) U.S. Cl. ..... 281/29; 281/3.1; 281/4; 281/15.1; 281/19.1; 281/19.2; 281/20; 281/21.1; 281/34; 412/4; 412/6; 412/8; 402/57; 402/79

(58) Field of Classification Search ..... 281/29, 281/31, 37, 38; 402/8, 12, 57, 79; *B42D 03/00; B42F 13/00*

See application file for complete search history.

(56) References Cited

U.S. PATENT DOCUMENTS 3,964,770 A * 6/1976 Abildgaard et al. ..... 281/29
4,519,629 A * 5/1985 Podosek ..... 281/27.2
5,997,207 A * 12/1999 Robinson ..... 402/79
2005/0104362 A1* 5/2005 Kam ..... 281/29

FOREIGN PATENT DOCUMENTS

TW M255159 U 1/2005

* cited by examiner

*Primary Examiner*—Dana Ross
*Assistant Examiner*—Justin V Lewis
(74) *Attorney, Agent, or Firm*—Muncy, Geissler, Olds & Lowe, PLLC

(57) ABSTRACT

An improved structure for book cover includes a cover layer, a left positioning plate and a right positioning plate, wherein the left and the right positioning plates are disposed above the cover layer and the edges of the cover layer can be folded inwardly for being adhered or stitched at the edges of the left and the right positioning plates, and the left and the right positioning plates respectively have a protruded left binding portion and a protruded right binding portion which both have plural holes corresponding to each other for fixing loose leaf papers between the left and the right positioning plates directly by a spiral so as to form a book. Through the improved structure of book cover in the present invention, the manufacturing process can be simplified and the cost of labor and material can be saved.

6 Claims, 5 Drawing Sheets

STRUCTURE FOR BOOK COVER

FIELD OF THE INVENTION

The present invention is related to an improved structure of cover, and more particularly to an improved structure for a book cover.

BACKGROUND OF THE INVENTION

The structure of conventional book, which is bound by plastic coil or spiral, is quite simple and also practical, such as a cheaper notebook or address book; however, the exposed plastic coil or spiral actually influences the appearance and the quality thereof. For improving the appearance, it is developed to hide the plastic coil or spiral inside the book. In a process, a spiral-bound book is fabricated first and then the book is covered by cardboard so that the book is composed of a cardboard cover, a spiral and plural inner leafs, wherein the plural leafs are bound by the spiral and then the cardboard is adhered inside the cover. Through this method, the book's appearance becomes more beautiful; however, the book still might be torn or be separated from the cover owing to the structure of the book is composed of spiral and paper. Another process is to additionally stitch a leather layer for covering the exposed spiral, in which the book's structure includes a leather layer, a plastic front cover, a plastic back cover, a spiral, and plural leafs, wherein the plastic front cover, the plastic back cover and the leafs are bound by the spiral to form a book and the leather layer is stitched to cover on the exposed spiral. Through this method, the structure of the book becomes more durable; however, the spiral might still be exposed owing to a loosening of the stitch, and further, the stitches also might influence the appearance.

If using a cover to cover the spiral or coil-bound book, the outer leather layer should be bought additionally, and the conventional cover structure of book, as disclosed in R.O.C. Patent no. M255159, is formed by high frequency melting lining leather layer, left positioning plate, right positioning and cover leather layer together, inwardly folding the two edges and stitching for fixing, and then the upper and the lower edges of the leather layer which are previously reserved are inwardly folded to form a folding for stitching and fixing so that the edges can be protected from destruction. The areas of the right part and the left part of respective the lining leather layer and the cover leather layer are larger than those of the left and the right positioning plates so that after the high frequency melting, the lining leather layer and the cover leather layer may form a left folding pieces and a right folding piece. When the pieces are inwardly folded and stitched, a left pocket and a right pocket are formed to provide the spaces for inserting the front and the back covers of paperback or spiral-bound book. In other embodiment, the loose leafs are bound by a binder riveted inside the book, but, in this method, the material for forming the cover becomes more because it needs to reserve the leather for forming the folding edges and the left and the sight pockets, and further, after high frequency melting, it still needs at least two stitching procedures for finishing the product. Therefore, obviously, the structure still can be simplified and improved, and further, for riveting the binder, a harder plate should be added which also increase the cost and manufacturing process.

SUMMARY OF THE INVENTION

One object of the present invention is to provide a book cover structure having a simplified processing procedure.

In the present invention, one embodiment includes a cover layer, a left positioning plate and a right positioning plate, wherein the cover layer can be folded up inwardly to form an upper folded edge, a lower folded edge, a left folded edge and a right folded edge which are adhered or stitched on the left and the right positioning plates, the edges of the left and the right positioning plates which are adjacent to each other respectively have a protruded left binding portion and a protruded right binding portion which both have plural holes corresponding to each other for fixing loose leaf papers between the left and the right positioning plates directly by a spiral so as to form a book, characterized in that the cover layer has a relatively larger area than the left and the right positioning plates so that the edges of the cover layer can have protruding portions for inward folding and adhering or stitching, a space is reserved between the left and the right positioning plates for containing the loose leaf papers, the edges of the left and the right positioning plates which are located aside the space respectively have a protruded left binding portion and a protruded right binding portion, and the length of the left and the right binding portions is less than that of the edges of the left and the right positioning plates and the binding portions respectively have plural holes corresponding to each other so that as binding, it only needs to fold the cover layer for lapping the positioning plates and expose the binding portions at the outer side, the loose leaf papers can be directly bound between the left and the right positioning plates through the spiral or plastic coil for forming a book.

Through the improved structure of book cover according to the present invention, the loose leaf papers can be directly bound inside the book for simplifying the manufacturing procedure and saving cost of labor and material, and further, since the spiral or plastic coil will not be exposed, the appearance of finished product becomes more elegant and more beautiful.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENT

Figure 1:
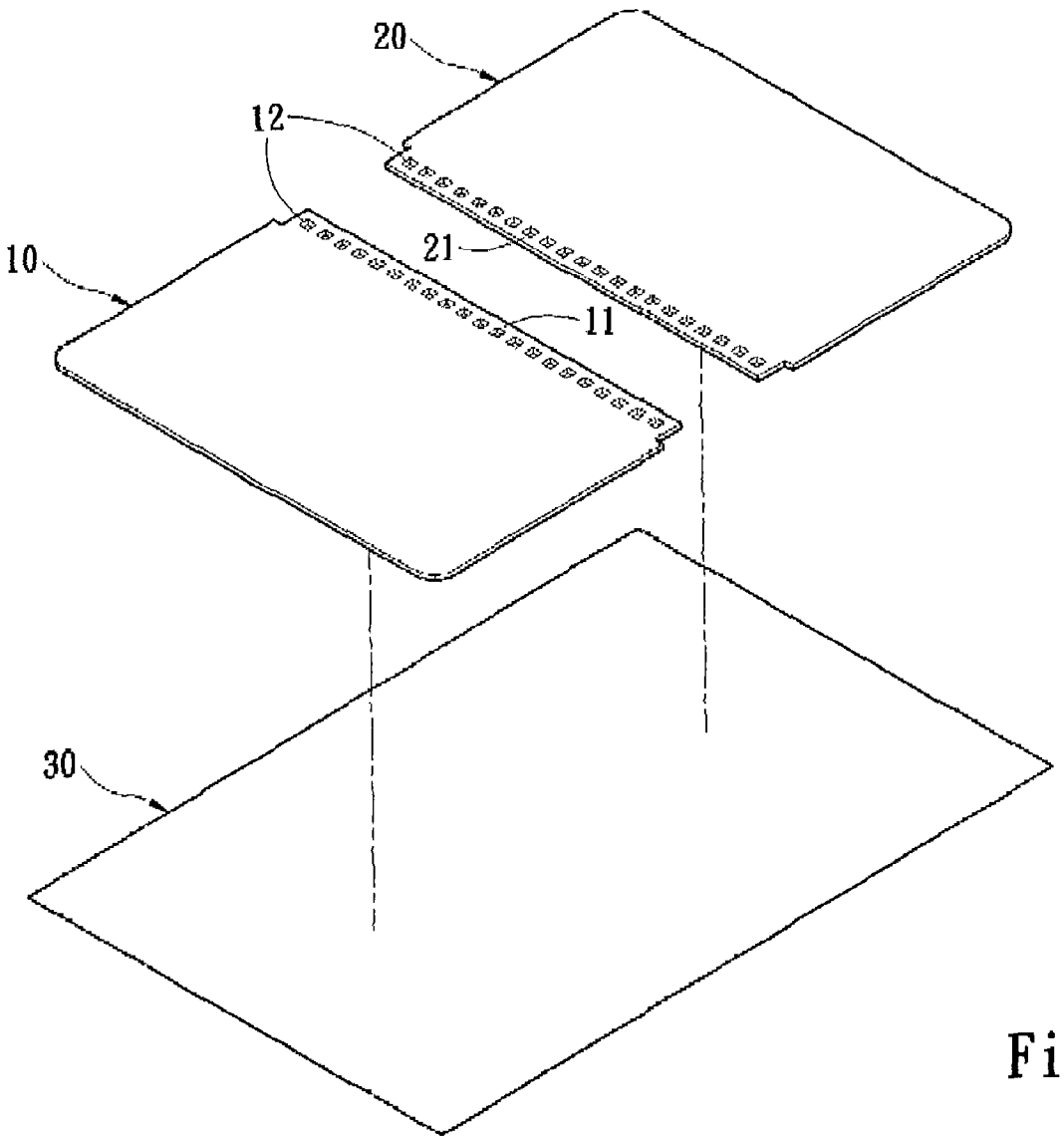
FIG. 1 is a 3D decomposition drawing showing a preferred embodiment in the present invention before processing.
Figure 2:
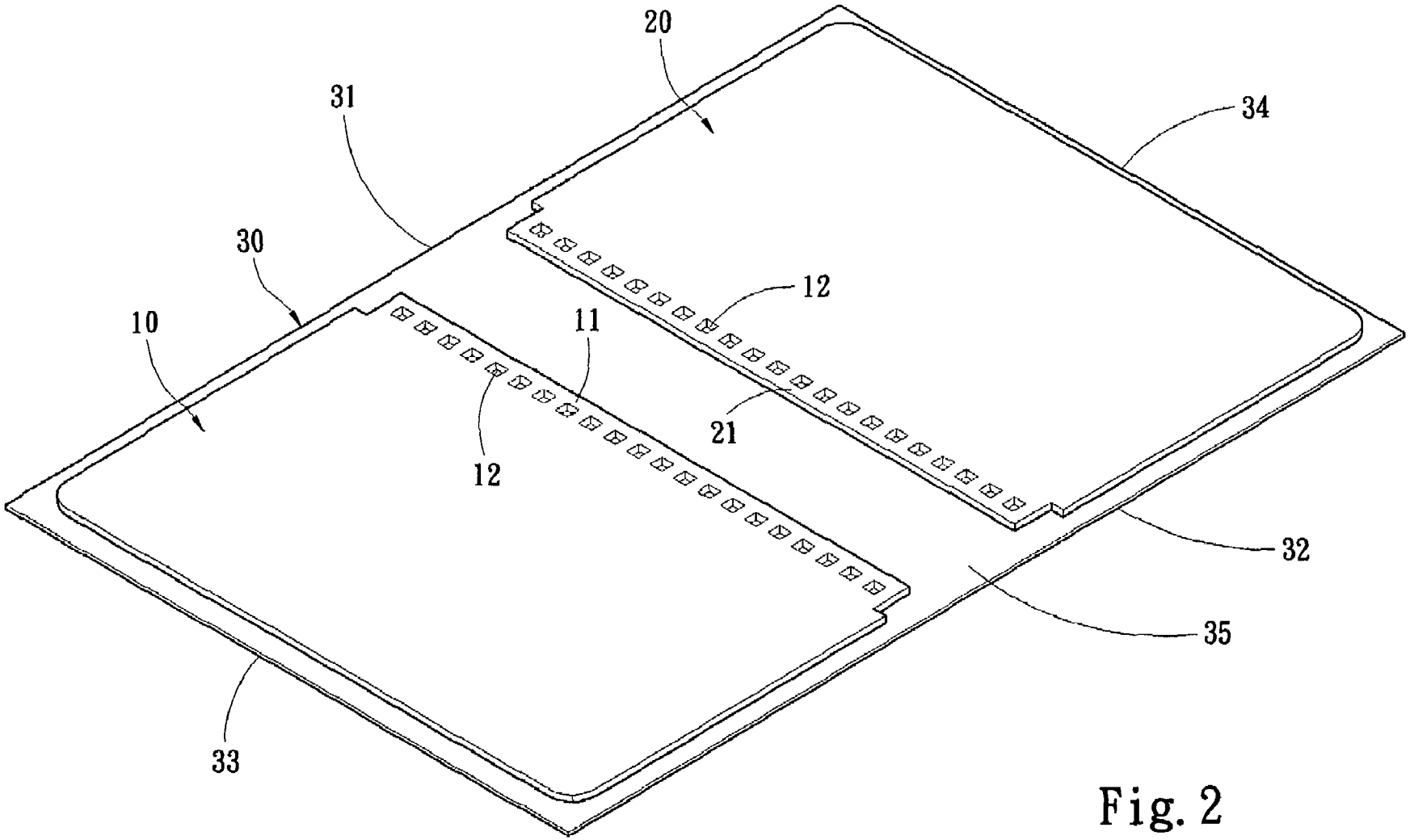
FIG. 2 is a 3D drawing showing a preferred embodiment in the present invention before processing.
Figure 3:
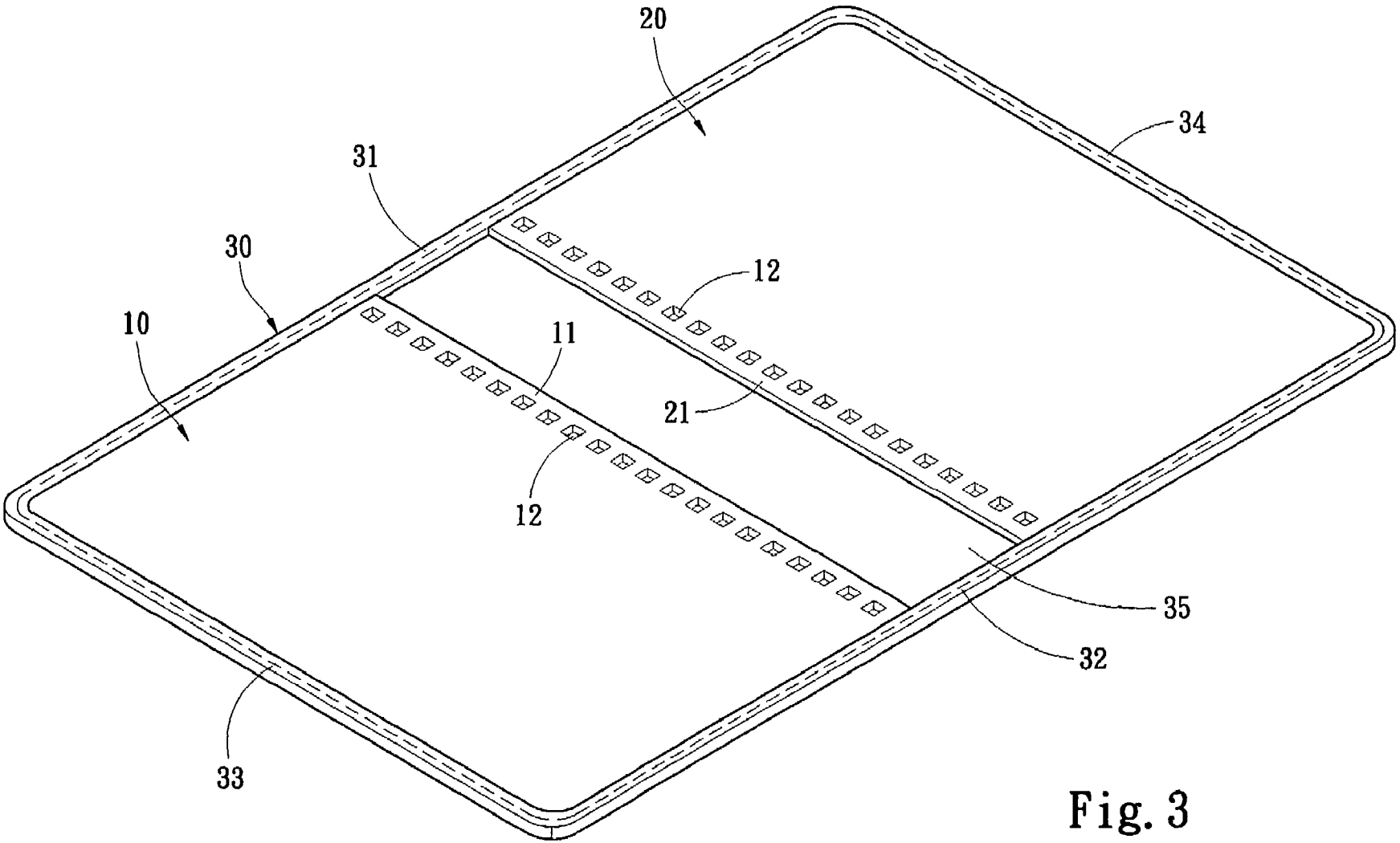
FIG. 3 is a 3D drawing showing a preferred embodiment in the present invention after processing.

Please refer to FIGS. 1~3 which are respectively showing a 3D decomposition drawing before processing, a 3D drawing before processing and a 3D drawing after processed for a preferred embodiment in the present invention.

In one embodiment according to the present invention, the book includes a cover layer 30, a left positioning plate 10 and a right positioning plate 20, wherein the left and the right positioning plates 10, 20 are located on the cover layer 30, which has a relatively larger area, so that a space 35 can be reserved between the left and the right positioning plates 10,

20 without exceeding the area range of the cover layer 30, and further, even a closest edge of the left and the right positioning plates 10, 20 to that of the cover layer 30, a distance will still be kept therebetween so that a portion of the cover layer 30 can be folded up inwardly to cover the edges of the left and the right positioning plates 10, 20 and after being adhered or stitched (or high frequency melted) on the left and the right positioning plates 10, 20, an upper folded edge 31, a lower folded edge 32, a left folded edge 33 and a right folded edge 34 can be formed. The edges of the left and the right positioning plates 10, 20 which are adjacent to each other respectively have a protruded left binding portion 11 and a protruded right binding portion 21 which both have plural holes 12 corresponding to each other, wherein the length of the left and the right binding portions 11, 21 is less than the distance between the upper folded edge 31 and the lower folded edge 32.

Figure 4:
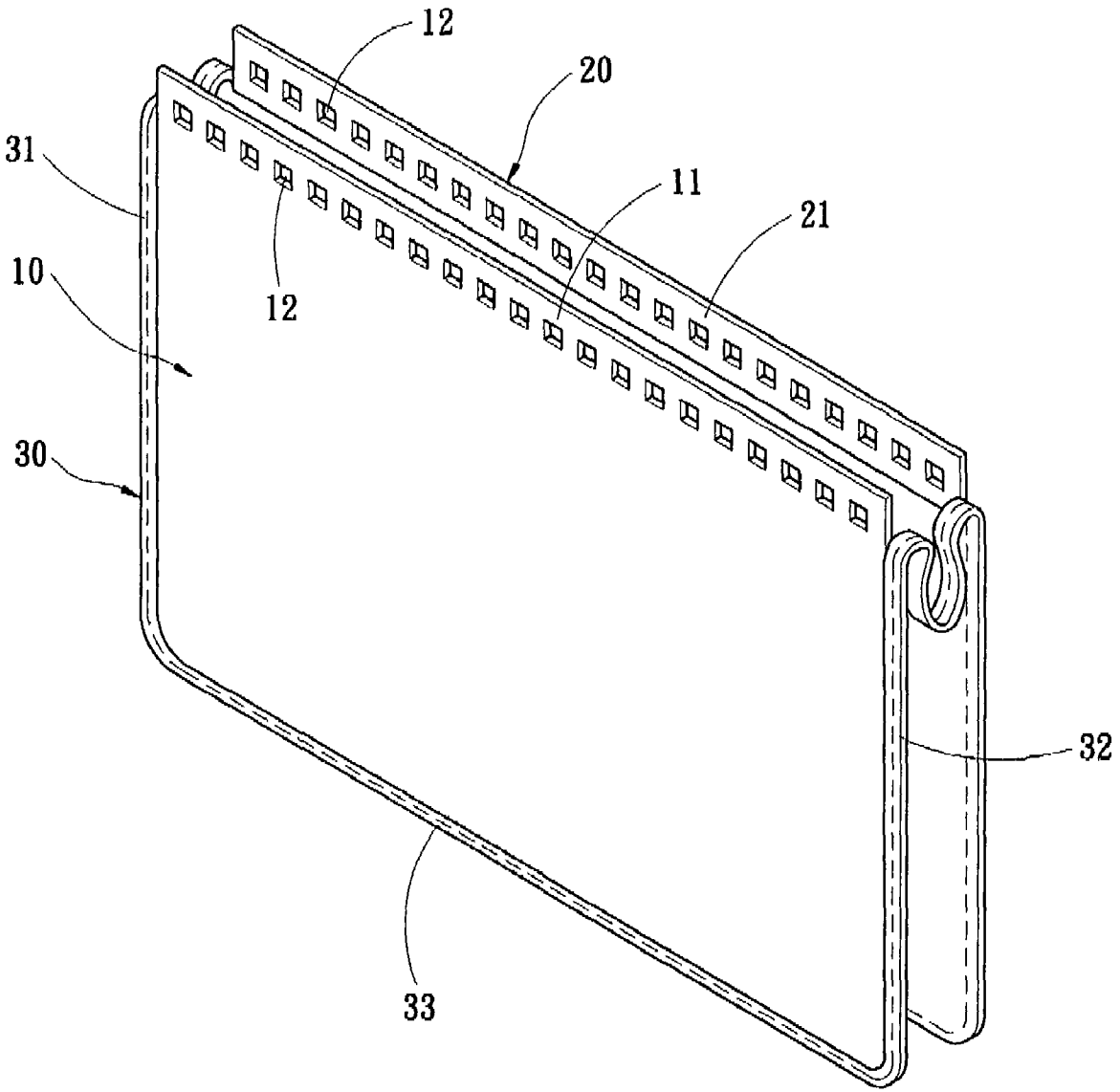
FIG. 4 is a 3D drawing showing the folding in a preferred embodiment of the present invention.
Figure 5:
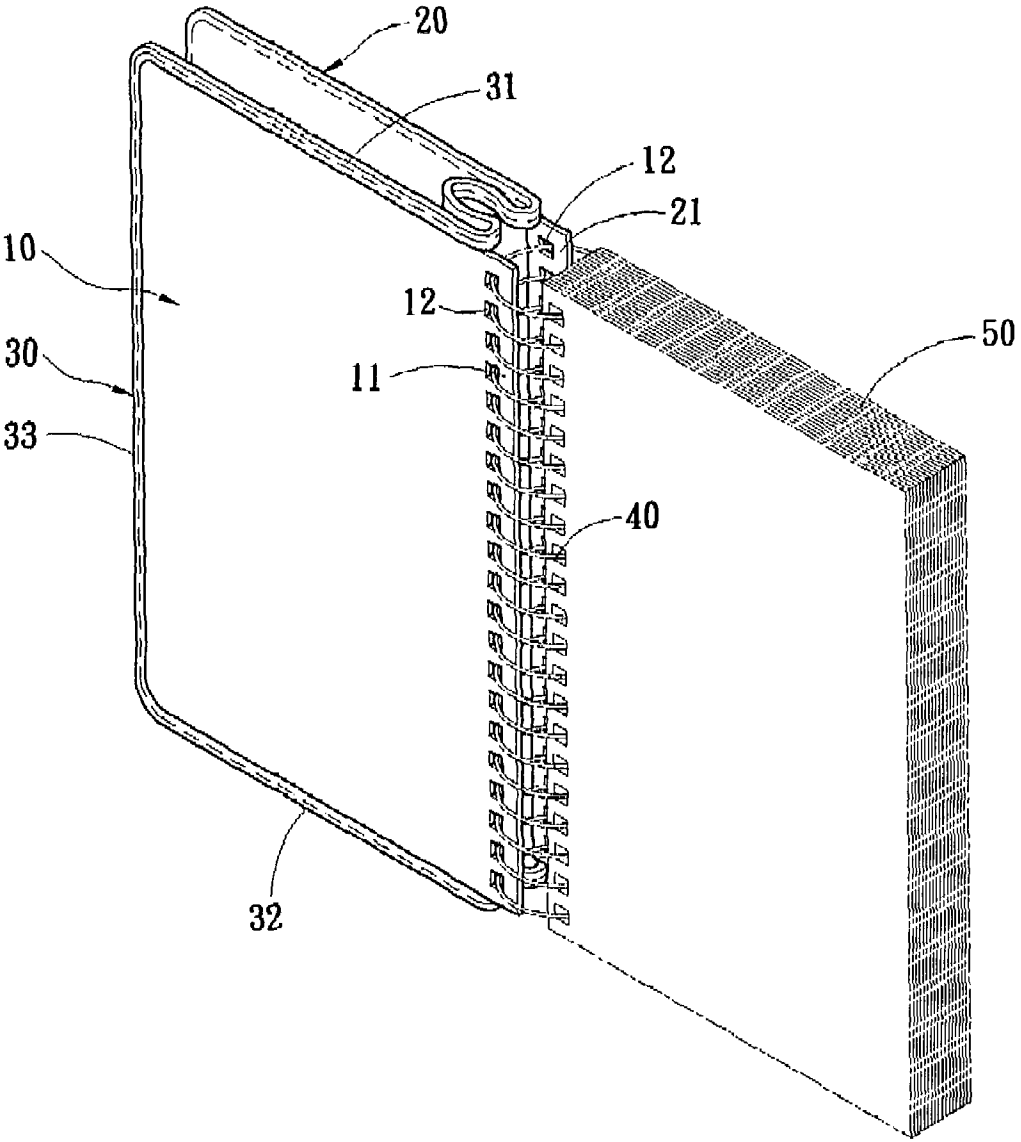
FIG. 5 is a 3D drawing showing the using status in a preferred embodiment of the present invention.

As using or binding, according to this embodiment, it only needs to outwardly fold the cover layer for lapping the left and the right positioning plates 10, 20 (as shown in FIGS. 4 and 5), and then the binding portions 11, 21 can be exposed at the outer side and also the holes 12 so that loose leaf papers 50 can be bound between the left and the right positioning plates 10, 20 through a spiral 40. Therefore, a book is formed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An improved structure for book cover, comprising:

a rigid left positioning plate having a protruded left binding portion; a rigid right positioning plate having a protruded right binding portion;

wherein each binding portion has a reduced length compared to its corresponding positioning plate, so that top and bottom edges of said binding portions are recessed from the corresponding top and bottom edges of the positioning plates; and a cover layer, wherein the left and the right positioning plates are located on the cover layer, which has a relatively larger area, so that a space is reserved between the left and the right positioning plates without exceeding the area range of the cover layer, and a distance between any edge of the left and the right positioning plates and an edge of the cover layer closest thereto is kept for defining a folding border so as to facilitate the cover layer to be folded up inwardly to cover the edges of the left and the right positioning plates and form at least upper and lower folded edges, and the edges of the left and the right positioning plates which are adjacent to each other respectively have the protruded left binding portion and the protruded right binding portion which both have a plurality of holes corresponding to each other, the length of the left and right binding portions being less than the distance between the upper folded edge and the lower folded edge so that the top and bottom edges of the binding portions are not covered by the folding edges and the binding portions and the holes are exposed at the outer side so that loose leaf papers can be bound between the left and right positioning plates through a spiral.

2. The improved structure for book cover as claimed in claim 1, wherein the folding border is adhered to the edges of the left and the right positioning plates.

3. The improved structure for book cover as claimed in claim 1, wherein the folding border is adhered to the edges of the left and the right positioning plates by stitching.

4. The improved structure for book cover as claimed in claim 1, wherein the folding border is adhered to the edges of the left and the right positioning plates by a high frequency melting.

5. The improved structure for book cover as claimed in claim 1, wherein when the cover layer is bent outwardly so that outer faces of the positioning plates face each other, the top and bottom edges of the binding portions are uncovered by the folded edges for easy access to said plurality of holes.

6. The improved structure for book cover as claimed in claim 5, wherein a portion of the cover layer covering the space between the positioning plates is folded between the outer faces of the positioning plates when the cover layer is bent outwardly.

* * * * *